United States Patent [19]

Stangeland et al.

[11] 4,011,154

[45] Mar. 8, 1977

[54] PRODUCTION OF LUBRICATING OILS

[75] Inventors: Bruce E. Stangeland, Berkeley; Harold F. Mason, Moraga, both of Calif.

[73] Assignee: Chevron Research Company, San Francisco, Calif.

[22] Filed: June 18, 1976

[21] Appl. No.: 697,670

Related U.S. Application Data

[63] Continuation-in-part of Ser. No. 345,150, March 26, 1973, abandoned.

[52] U.S. Cl. ..... 208/59; 208/18; 208/80; 208/86; 208/93

[51] Int. Cl.[2] ..... C10G 13/00; C10G 37/02

[58] Field of Search ..... 208/18, 59, 79, 80, 208/86, 93

[56] References Cited

UNITED STATES PATENTS 3,579,435 5/1971 Olenzak et al. ..... 208/19

*Primary Examiner*—Herbert Levine

*Attorney, Agent, or Firm*—G. F. Magdeburger; R. H. Davies; W. D. Reese

[57] ABSTRACT

A process is disclosed for producing a lubricating oil base stock by: (1) fractionating a hydrocarbon feedstock boiling above 650° F into a plurality of fractions including at least a lower-boiling fraction and a higher-boiling fraction; (2) contacting the lower-boiling fraction and hydrogen in a first hydrocracking zone, at hydrocracking conditions, with a hydrocracking catalyst to obtain an effluent comprising hydrocarbons boiling in the range of the feedstock and hydrocarbons boiling below the boiling range of the feedstock; (3) contacting at least the hydrocarbons boiling in the range of said feedstock formed in step (2), the higher-boiling fraction from step (1) without substantial intermediate deasphalting thereof, and hydrogen in a second hydrocracking zone, at hydrocracking conditions, with a hydrocracking catalyst to obtain a lubricating oil base stock including a plurality of lube oil fractions of reduced viscosity index spread over the range of the lube oil fractions; and recovering the lube oil base stock. Preferably, the resulting lube oil base stocks have a viscosity index spread of not more than about 15 units, preferably not more than 10, over the lube oil base stock viscosity range of light neutrals to bright stocks.

5 Claims, 1 Drawing Figure

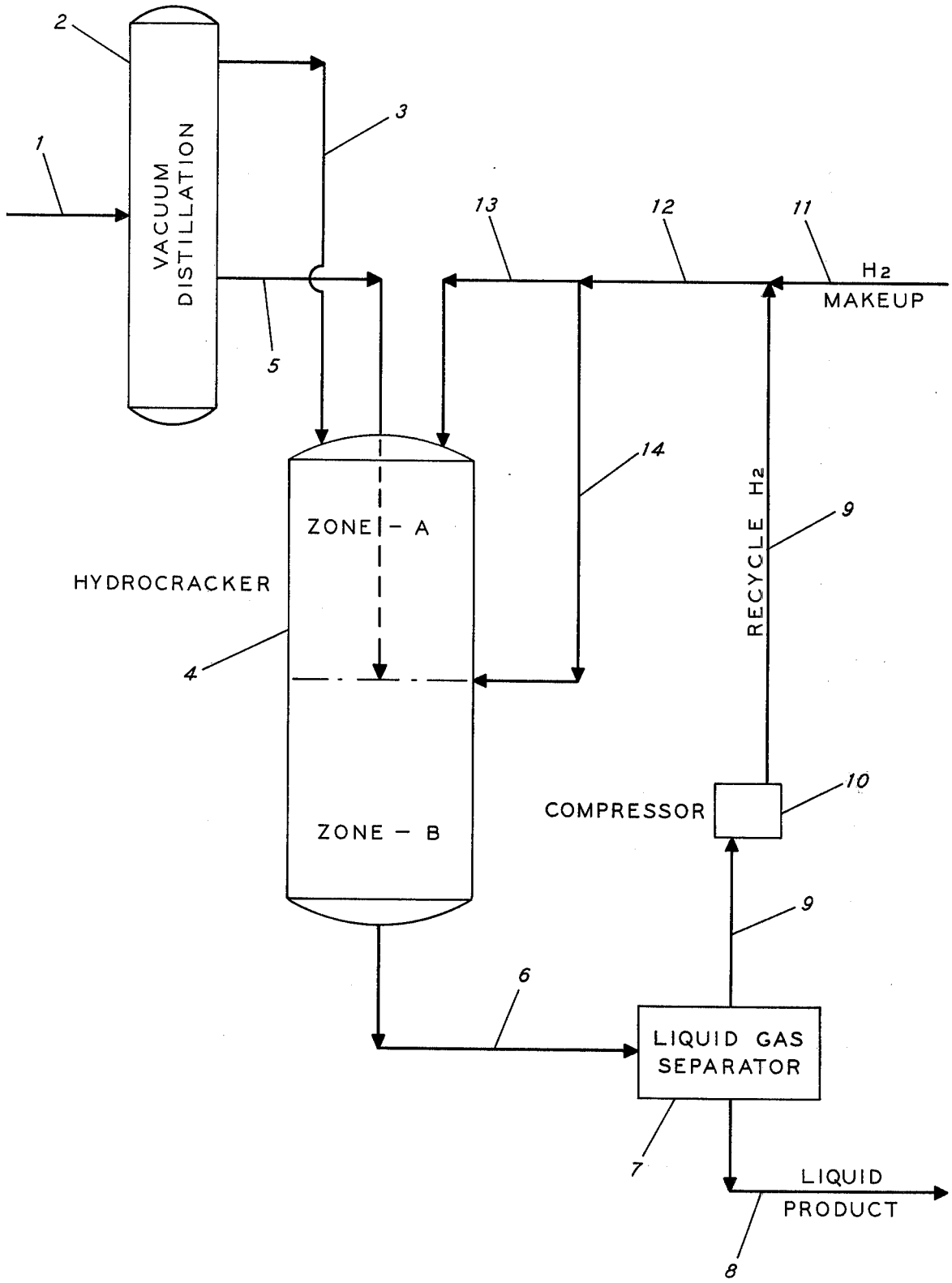
2
1
VACUUM DISTILLATION
3
5
13
12
11
H2
MAKEUP
14
ZONE - A
HYDROCRACKER
4
ZONE - B
RECYCLE H2
9
COMPRESSOR
10
9
6
LIQUID GAS SEPARATOR
7
LIQUID PRODUCT
8

PRODUCTION OF LUBRICATING OILS

CROSS REFERENCE TO RELATED APPLICATIONS

This application is a continuation-in-part of our copending application, Ser. No. 345,150, filed Mar. 26, 1973 now abandoned.

BACKGROUND OF THE INVENTION

1. Field of the Invention

The present invention relates to a process for production of hydrocracked lubricating oil base stocks.

Hydrocracked lube oil base stocks are useful as economical substitutes for stocks which have heretofore been prepared by distillation of crude oils. One of the major drawbacks in using hydrocracked heavy gas oils and solvent-deasphalted oils to manufacture lube stocks is the wide variance in viscosity index of the various lube oil fractions. Typically, viscosity indices of the light neutrals are lower than the viscosity indices of the heavy neutrals and bright stocks. Separate hydrocracking for the heavy and light portions of the feed has been suggested. This procedure is expensive and leads to rapid and serious catalyst fouling.

The process of the present invention reduces the spread of viscosity indices with a simpler and more economical processing scheme than available in prior art, along with reduced catalyst fouling.

2. Description of the Prior Art

U.S. Pat. No. 3,579,435 describes hydrocracking lubricating oil stocks to provide lubricating oils of higher viscosity index by fractionating portions of crude oil suitable for hydrocracking and more severely hydrocracking the higher-boiling fractions by providing additional cracking contacting for the higher-boiling materials.

British Pat. No. 1,233,973 teaches production of lube oil by hydrogenating an organic feedstock with a catalyst having a not-strongly-acidic support, followed by treating the intermediate product with a catalyst having a more strongly acidic support.

U.S. Pat. No. 3,242,068 teaches preparation of a lube oil by hydrofining a predominantly paraffinic hydrocarbon oil feed, followed by hydrocracking and isomerizing the hydrofined hydrocarbon feed over a nickel-sulfide-containing or cobalt-sulfide-containing catalyst.

cracking processes for producing lubricating oils. U.S. Pat. Nos. 3,240,694, 3,243,367, 3,267,021 and 3,617,482 teach split feed hydrocracking processes for preparing a variety of products. U.S. Pat. No. 3,617,482 is directed to lube oil production.

U.S. Pat. Nos. 3,682,813, 3,617,482, 3,617,484, 3,649,518, 3,649,519 and 3,654,133 teach multiple-stage hydrocracking processes for producing lubricating oils. U.S Pat. No. 3,617,484, in particular, teaches a process for increasing the viscosity index of a light lube fraction, approximating the viscosity range of a 100 neutral oil which has been hydrocracked as part of a relatively wide range fraction, wherein the light lube fraction is isolated and rehydrocracked in the absence of heavier fractions.

SUMMARY OF THE INVENTION

The present invention is directed to a process for producing lube oil base stocks having a controlled viscosity index over the range of lube oil fractions by: (1) fractionating a hydrocarbon feedstock boiling above 650° F into a plurality of fractions including at least a lower-boiling fraction and a higher-boiling fraction: (2) contacting the lower-boiling fraction and hydrogen in a first hydrocracking zone, at hydrocracking conditions, with a hydrocracking catalyst to obtain an effluent comprising hydrocarbons boiling in the range of the feedstock and hydrocarbons boiling below the boiling range of the feedstock; (3) contacting at least the hydrocarbons boiling in the range of said feedstock formed in step (2), the higher-boiling fraction from step (1) without substantial intermediate deasphalting thereof, and hydrogen in a second hydrocracking zone, at hydrocracking conditions, with a hydrocracking catalyst to obtain a lubricating oil base stock including a plurality of lube oil fractions of reduced viscosity index spread over the range of the lube oil fractions; and recovering the lube oil base stock.

By the process of the present invention, the viscosity indices of the lighter portions of the recovered lube oil base stock are upgraded sufficiently to be within the general range of those of the heavier fractions.

DETAILED DESCRIPTION OF THE INVENTION

BRIEF DESCRIPTION OF THE DRAWING

The drawing is a schematic illustration of one preferred embodiment of the process of the present invention.

OPERATING CONDITIONS IN THE HYDROCRACKING ZONES

The process conditions in the hydrocracking zones are those typical of hydrocracking operations. A temperature of about 500°–900° F, preferably 650°–800° F., is used. A pressure from about 500 to about 10,000 psig, preferably 500 to 3000 psig, is used, with a liquid hourly space velocity from 0.2 to 5.0, preferably 0.5 to 2.0, more preferably 0.5 to 1.0. The hydrogen supply rate (makeup and recycle) to the hydrocracking zones is in the range from about 500 to about 20,000 SCF per barrel of hydrocarbon feed, preferably about 2,000 to about 5,000 SCF per barrel.

It should be noted that, while hydrocracking is the primary reaction being carried out, the feedstocks used generally contain organic compounds of sulfur, nitrogen, oxygen and even metals in some cases. Therefore, hydrodesulfurization, hydrodenitrification, etc. also occur to a greater or lesser extent.

HYDROCRACKING CATALYSTS

Catalysts employed in the hydrocracking zones include those having hydrogenation-dehydrogenation activity, together with an active cracking component support. Exemplary cracking component supports include silica-alumina, silica-alumina-zirconia composites, acid-treated clays, crystalline aluminosilicate zeolitic molecular sieves such as Zeolite A, Faujasite, Zeolite X and Zeolite Y, and combinations of the above. Hydrogenation-dehydrogenation components of the catalyst preferably comprise a metal selected from Group VIII metals and compounds thereof and Group VIB metals and compounds thereof. Preferred Group VIII components include cobalt, nickel, platinum and palladium, particularly the oxides and sulfides of cobalt and nickel. Preferred Group VIB components are the oxides and sulfides of molybdenum and tungsten. Thus, examples of hydrocracking catalysts which would be preferred for use in the process are the combinations nickel-tungsten-silica-alumina and nickel-molybdenum-silica-alumina. Such catalysts may vary in their activities for hydrogenation and for cracking and in their ability to sustain high activity during long periods of use depending on their compositions and methods of preparation. It will be within the ability of those skilled in the art from the description herein, to choose the optimum catalyst or catalysts for use with a given feedstock.

A particularly preferred hydrocracking catalyst for use in the present process is a nickel sulfide-tungsten sulfide on a silica-alumina base containing discrete, metal phosphate particles, such as that described in U.S. Pat. No. 3,493,517, the teachings of which are incorporated herein by reference.

PROCESS OPERATION

Referring now to the drawing, a feedstock is fed via line 1 to a vacuum distillation column 2. A lighter fraction is removed from column 2 via line 3 and introduced into the top of hydrocracking reactor 4. A heavier fraction is removed from the column 2 via line 5 and passed into hydrocracker 4 at an intermediate position without intermediate treatment, so that it only passes through zone B, as opposed to the lighter fraction, which passes through both zones A and B. The effluent from reactor 4 is fed via line 6 into a liquid-gas separator 7, from which a liquid phase stream is withdrawn via line 8. A gaseous, hydrogen-rich stream is withdrawn via line 9 and gaseous hydrocarbons are removed by conventional means not shown. The hydrogen-rich gas is compressed by compressor 10, combined with makeup hydrogen from line 11 and fed via (1) lines 12 and 13, and (2) lines 12 and 14 to zone A and zone B, respectively, of hydrocracker 4.

By the process described, a liquid product is obtained from which a lubricating oil base stock fraction comprising a plurality of lube oil fractions can be separated which has a reduced viscosity index spread over the range of the lube oil fractions recovered. Preferably, the viscosity index spread will be no more than about 15 units, and more preferably no more than about 10 units, over the entire range of lube oil fractions.

FEEDSTOCKS

A wide variety of feedstocks may be used in the process of the present invention. Particularly preferred feedstocks are vacuum gas oils with boiling ranges from about 650° to about 1050° F, and solvent deasphalted oils having boiling ranges from about 900° to about 1200° F. Reduced topped crude oils as well as atmospheric residua and the like may also be used. The feedstocks used preferably are limited to hydrocarbon materials boiling above 650° F, preferably in the range of about 700° to about 1200° F.

The process of the present invention adjusts the severity of hydrocracking of heavier and lighter fractions of the hydrocarbon feedstock. That is, more cracking of the light components of the feed than of the heavy components is desired. This is accomplished by contacting the lighter portion of the feedstock in both catalyst zones A and B, while the heavy portion of the feed, without intermediate deasphalting or other substantial alteration, is contacted only in zone B. Zone A may be operated at more severe conditions (e.g., higher temperatures, higher pressures and lower space velocities) than zone B to further increase the cracking of the light components. Hydrogen introduced through conduit 11 can be used to quench the temperature in zone B to reduce the amount of cracking therein. The catalyst in zone A may be selected to provide higher cracking activity than the catalyst used in zone B.

In an alternative embodiment, a portion of the light or medium neutrals recovered in the liquid product may be recycled to zone A to effect further viscosity index upgrading thereof.

It may be desirable to split the feedstock into three or more fractions and to employ a third catalyst zone in a manner analogous to the two-zone process scheme described in detail above. That is, a first, lower-boiling fraction would contact catalyst zones A, B and C in order. A second, intermediate-boiling fraction would contact catalyst zones B and C without intermediate deasphalting or other treatment, while the third, highest-boiling fraction would contact only catalyst zone C without intermediate deasphalting or other treatment.

The following example illustrates the process of this invention and does not limit the scope of the invention.

EXAMPLE

A. A first sample of a California deasphalted oil having the properties shown in Table I is split by fractionation into a lighter fraction, boiling below 1,000° F (about 50%, by weight of the oil) and a heavier fraction. The lighter fraction is hydrocracked to a VI of 58 at a temperature of 790° F, a pressure of 2400 and LHSV of 1.0, using a catalyst having the composition shown in Table II.

TABLE I

| | | |
|---|---|---|
| 15.5 | °API | |
| 1.37% | Sulfur | |
| .48% | Nitrogen | |
| Dewaxed VI = | | +6 |
| SUS at 210° F = | | 370 |
| D-1160 | | |
| Start to 10% | | 686/849 |
| 30 to 50% | | 944/1012 |

TABLE II

| Catalyst No. | Method of Preparation | Wt. % of Constituents | |
|---|---|---|---|
| 1 | Cogelled | NiO | 12.7% |
| | | $WO_3$ | 12.6% |
| | | $SiO_2$ | 34.7% |
| | | $Al_2O_3$ | 30.0% |
| | | $TiO_2$ | 10.0% |

The hydrocracked product formed from the lighter fraction is then mixed with the heavier 1,000° F+ fraction (all material boiling above 1,000° F) and this mixture is hydrocracked over the catalyst described in Table III at 800° F, 0.59 LHSV and a pressure of 2,400.

TABLE III

| Catalyst No. | Method of Preparation | Wt. % of Constituents | |
|---|---|---|---|
| 2 | Cogelled | NiO | 10.5% |
| | | $WO_3$ | 24.5% |
| | | $SiO_2$ | 27.0% |
| | | $Al_2O_3$ | 30.0% |
| | | $TiO_2$ | 8.0% |

B. For purposes of comparison with the present invention as shown in part A, a sample of the whole California deasphalted oil is hydrocracked over the catalyst described in Table III at 803° F, a pressure of 2400, and an LHSV of 0.59.

The products of Runs A and B are compared in Table IV below:

TABLE IV

| Process | Viscosity of Various Cuts at 100° F in SUS Units | Corresponding Viscosity Index | Yields Wt. % 700° F+ Dewaxed Oil as of Whole DAO Feed |
|---|---|---|---|
| Split Feed (A) | 130 neutral | 100 | 27.7 |
| | 350 neutral | 106.5 | |
| | 1,800 (bright stock) | 101.5 | |
| Whole Feed (B) | 130 neutral | 100 | |
| | 350 neutral | 106.5 | 22.3 |
| | 1,100 bright stock | 108 | |

The advantages of the present process (Run A) are evident from the comparative data of Table IV, showing:

1. a 20% higher yield of lube oil;
2. higher viscosity of the bright stock due to less overcracking; and
3. lower VI of the bright stock which indicates lower aniline point, facilitating dissolving additives.

It is apparent that there are many embodiments of this invention, in addition to those illustrated, which are within the scope and spirit thereof; and, therefore, the scope of the invention is to be measured by the appended claims.

What is claimed is:

1. A process for producing a lubricating oil base stock comprising:

1. fractionating a hydrocarbon feedstock boiling above 650° F into a plurality of fractions including at least a lower-boiling fraction and a higher-boiling fraction;
2. contacting said lower-boiling fraction and hydrogen in a first hydrocracking zone, at hydrocracking conditions, with a hydrocracking catalyst to obtain an effluent comprising:
   a. hydrocarbons boiling in the range of said feedstock, and
   b. hydrocarbons boiling below the boiling range of said feedstock;
3. contacting (a) said hydrocarbons formed in step (2) boiling in the range of said feedstock, (b) said higher-boiling fraction, formed in step (1) without intermediate deasphalting thereof, and (c) hydrogen in a second hydrocracking zone, at hydrocracking conditions, with a hydrocracking catalyst to obtain a lubricating oil base stock comprising a plurality of lube oil fractions of reduced viscosity index spread over the range of said lube oil fractions; and
4. recovering said lubricating oil base stock.

2. The process of claim 1 wherein the hydrocracking conditions in step (2) include a higher temperature than the hydrocracking conditions in step (3).

3. The process of claim 1 wherein the hydrocracking catalyst in said first zone is the same as the hydrocracking catalyst in said second zone.

4. The process of claim 3 wherein said hydrocarbon feedstock is a solvent deasphalted oil boiling in the range of from about 900° to about 1200° F, said lower boiling fraction has a boiling range of from about 900° to about 1000° F, and said higher boiling fraction has a boiling range of from about 1000° to about 1200° F, said lubricating oil base stock includes a 1000° F+ bright stock, and the viscosity index spread between a 130 neutral fraction of said base stock and said bright stock is not more than 15 V.I. units.

5. The process of claim 4 wherein the viscosity index spread between said 130 neutral fraction and said 1000° F+ bright stock fraction is not more than 10 V.I. units.

* * * * *

UNITED STATES PATENT AND TRADEMARK OFFICE

CERTIFICATE OF CORRECTION

PATENT NO. : 4,011,154

DATED : March 8, 1977

INVENTOR(S) : Bruce E. Stangeland

It is certified that error appears in the above-identified patent and that said Letters Patent are hereby corrected as shown below:

Col. 1, line 49, should read --U.S. Patents 3,308,055 and 3,663,423 teach hydrocracking processes for producing lubricating oils. U.S.--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*